US007419050B2

(12) United States Patent
Westerkamp et al.

(10) Patent No.: US 7,419,050 B2
(45) Date of Patent: Sep. 2, 2008

(54) PROCESS BELT WITH VARIABLY ADJUSTABLE RELEASE CHARACTERISTICS

(75) Inventors: Arved H. Westerkamp, Dettingen/Erms (DE); Matthias Schmitt, Munich (DE)

(73) Assignee: Voith Patent GmbH, Heidenheim (DE)

( * ) Notice: Subject to any disclaimer, the term of this patent is extended or adjusted under 35 U.S.C. 154(b) by 0 days.

(21) Appl. No.: 11/624,881

(22) Filed: Jan. 19, 2007

(65) Prior Publication Data

US 2007/0169909 A1 Jul. 26, 2007

(30) Foreign Application Priority Data

Jan. 26, 2006 (DE) ..... 10 2006 003 705

(51) Int. Cl.
*B65G 15/34* (2006.01)

(52) U.S. Cl. ..... 198/847; 198/846; 162/358.4

(58) Field of Classification Search ..... 198/846, 198/847, 844.1; 162/358.4; 210/504, 507; 442/118, 153
See application file for complete search history.

(56) References Cited

U.S. PATENT DOCUMENTS

| | | | | |
|---|---|---|---|---|
| 5,167,771 | A * | 12/1992 | Sayers et al. | 162/358.4 |
| 5,196,092 | A | 3/1993 | Stigberg | |
| 5,277,728 | A * | 1/1994 | Stigberg | 156/154 |
| 6,092,645 | A * | 7/2000 | Wahren | 198/847 |
| 6,605,188 | B2 * | 8/2003 | Hagfors et al. | 162/306 |
| 6,769,535 | B2 * | 8/2004 | Zilker et al. | 198/847 |
| 6,962,885 | B1 | 11/2005 | Best | |
| 7,169,265 | B1 | 1/2007 | Kramer et al. | |
| 2002/0137416 | A1 | 9/2002 | Hagfors et al. | |

FOREIGN PATENT DOCUMENTS

| | | |
|---|---|---|
| DE | 19651557 | 6/1998 |
| EP | 0534041 | 3/1993 |
| EP | 0576115 | 4/1996 |
| WO | 01/27387 | 4/2001 |
| WO | 2004/061205 | 7/2004 |

* cited by examiner

*Primary Examiner*—James R Bidwell
(74) *Attorney, Agent, or Firm*—Greenblum & Bernstein, P.L.C.

(57) ABSTRACT

A transport belt, in particular for machines for the production of web material such as paper or paperboard, which on a web material contact side (18) includes at least two material layers (20, 22, 24) of different material arranged one above the other, wherein prior to starting up for the first time the transport belt (10) is subjected on its web material contact side (18), at least in some regions, to a material-removing process such that the transport belt (10) has on its web material contact side (18) a web material contact surface (26) provided by various material layers (20, 22, 24).

17 Claims, 1 Drawing Sheet

PROCESS BELT WITH VARIABLY ADJUSTABLE RELEASE CHARACTERISTICS

CROSS-REFERENCE TO RELATED APPLICATIONS

The present application claims priority under 35 U.S.C. § 119 of German Patent Application No. 10 2006 003 705.7, filed Jan. 26, 2006, the disclosure of which is expressly incorporated by reference herein in its entirety.

BACKGROUND OF THE INVENTION

1. Field of the Invention

This invention relates to a transport belt such as can be used on machines for the production of web material for example, such as paper or paperboard for example. In particular, the present invention relates to a transport or process belt with variably adjustable release characteristics, and a method of manufacturing the transport or process belt.

2. Background and Related Information

Transport belts of this type are used in the production of paper, for example in regions in which the still wet paper material is passed through press sections in order to remove liquid still present in said material. For example, en route through two press rollers between the transport belt and the web material passes the still wet paper material, meaning the paper or the starting material for the paper, a thin liquid film from the water is pressed out of said material. Generally the transport belt is impermeable to water in order to provide as smooth a surface as possible and produce an accordingly unstructured image of this surface on the web material; hence the problem arises at the point where the transport belt is led away from web material that the existing thin film of liquid or water produces an adhesive effect. This impairs the releasing of the transport belt from the web material.

A method known from U.S. Pat. No. 6,962,885 B1, incorporated herein by reference in its entirety, to combat this problem is to provide, on the side of the transport belt which comes into contact with the web material, a thin layer which does not have a flat or smooth surface structure but a multiplicity of small depressions. The latter can be formed during the production of this thin layer by embedding grains of salt in the material. Where the gains of salt are not fully embedded they can be subsequently removed by dissolving in water, thus obtaining hollow spaces or depressions open to the surface. Water pressed out of the web material can be collected in these depressions and the adhesive effect can be at least lessened.

An approach known from EPO 576 115 B1, incorporated herein by reference in its entirety, is for the surface of the transport belt which comes into contact with the web material to be provided with a comparatively rough structure and at the same time to form this region of the transport belt from an elastic material. When the paper material is being pressed between two press rollers the comparatively rough surface is compressed. After it has passed through this press roller region the compressed transport belt relaxes, with the result that the serrated elevations forming the surface roughness create a disturbance in the existing water film, thus making it easier for the transport belt to detach from the web material.

SUMMARY OF THE INVENTION

The present invention provides a transport belt, in particular for machines for the production of web material such as paper or paperboard, with which it is possible to produce web material of high quality without the risk of unwanted adhesion.

In particular, the present invention provides a transport belt for the production of web material such as paper or paperboard, the transport belt including a web material contact side having at least two material layers composed of different materials arranged one above the other, and in at least two regions of the transport belt on the web material contact side, the at least two material layers are exposed at a web material contact surface.

In the transport belt of the present invention, the web material contact surface is provided by various materials, namely those materials with which the material layers, which were first arranged one above the other and then partly removed or exposed by a material-removing process, are constructed. This means that the surface which comes into contact with the web material is uniform and, with suitable processing, also smooth and essentially without inclination to marking. However, at the same time it has been shown that as the result of constructing the web material contact surface from various surface regions with accordingly different surface properties it is far easier for the transport belt to detach from the web material, for example after passing through a press nip, than compared to web material contact surfaces constructed from a uniform material.

In some embodiments, the transport belt of the present invention can have for example a belt core, on the web material contact side of which at least two material layers are arranged one above the other. Consequently, at least two surface regions of the web material contact surface can be provided by different materials or different material layers which are not already a part of the belt core as well. Hence the belt core can be constructed such that it meets in optimum manner the requirements imposed on it, in particular with regard to durability and tensile strength, without having to arrange for the belt core itself to meet special surface requirements in addition.

In some embodiments, the various layers in this case can be constructed from different polymer material. Alternatively or in addition it is possible for the various layers to differ in that they have a mutually different filler material and/or a mutually different filler material fraction. The various layers can be constructed furthermore from foils of different thickness.

In some embodiments, the present invention provides a transport belt for the production of web material such as paper or paperboard, comprising a web material contact side comprising at least two material layers of different material arranged one above the other, whereby prior to starting up for the first time, the transport belt is subjected on its web material contact side, at least in some regions, to a material-removing process such that the transport belt has on its web material contact side a web material contact surface provided by the at least two material layers.

In some embodiments, the transport belt can further include a belt core on the web material contact side of which at least two material layers are arranged one above the other. In some embodiments, the transport belt can include material layers having a thickness in the range from approximately 5 to approximately 50 μm. Also, in some embodiments, at least one of the material layers can comprise polyurethane material or be constructed with it. In addition, in some embodiments, to be able to influence the surface properties in defined manner, at least one of the material layers can contain a filler material, for example, titanium dioxide, calcium carbonate, graphite or metal material, such as particular aluminum or steel.

In some embodiments, the web material contact surface can include strip-shaped material layers of the various material layers extending side by side in a transport belt longitudinal direction (MD).

The present invention also relates to a method for manufacturing a transport belt for machines for the production of web material such as paper or paperboard, the method including forming a transport belt blank having on a web material contact side, at least two material layers composed of different materials, and processing a surface of the web material contact side to form at least two regions exposing the different material layers thereby forming a transport belt.

In some embodiments, the method of manufacturing a transport belt can further include processing a surface of the transport belt blank by grinding of the transport belt blank on the web material contact side.

Other exemplary embodiments and advantages of the present invention may be ascertained by reviewing the present disclosure and the accompanying drawings.

BRIEF DESCRIPTION OF THE DRAWINGS

The present invention is further described in the detailed description which follows, in reference to the noted plurality of drawings by way of non-limiting examples of preferred embodiments of the present invention, in which like numerals represent like elements throughout the several views of the drawings, and wherein.

DETAILED DESCRIPTION OF THE PREFERRED EMBODIMENTS

The particulars shown herein are by way of example and for purposes of illustrative discussion of the embodiments of the present invention only and are presented in the cause of providing what is believed to be the most useful and readily understood description of the principles and conceptual aspects of the present invention. In this regard, no attempt is made to show structural details of the present invention in more detail than is necessary for the fundamental understanding of the present invention, the description taken with the drawings making apparent to those skilled in the art how the several forms of the present invention may be embodied in practice.

Figure 1:
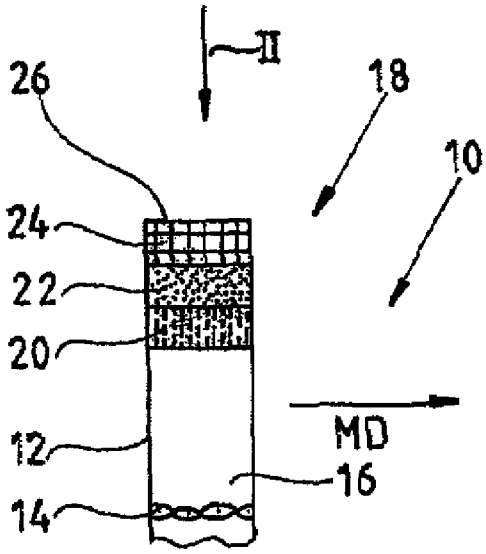
FIG. 1 represents a partial sectional illustration of a transport belt constructed according to the invention.

Referring to the drawings wherein like numerals represent like elements, in FIG. 1 the numeral 10 is used in general to designate a transport belt of the invention. The transport belt 10 comprises a belt core 12, which makes up an essential volume fraction of the transport belt 10. In the belt core 12 provision is made, approximately centrally in the thickness direction for example, for a reinforcement 14 which ensures above all the tensile strength of the transport belt 10. This reinforcement 14 can comprise fiber material, also as a fabric structure or the like for example. The reinforcement 14 is embedded in elastic material 16, which can also provide the essential volume fraction of the belt core 12. In some embodiments, the material 16 can be a polyurethane material for example. Of course it is also possible for the belt core 12 to be constructed from multiple layers and for it to be constructed on the side coming into contact with the guide or drive element, for example, from a different material than on the web material contact side 18.

From FIG. 1 it is evident that provision is made on the web material contact side 18 of the belt core 12 for three material layers 20, 22, 24. The material layers 20, 22, 24 are constructed from foils and thus have a comparatively small thickness compared to the thickness of the belt core 12. The proportions shown in FIG. 1 do not correspond in this case to the actual conditions. While the thickness of the belt core 12 lies in the range of a few millimeters, the thickness of the material layers 20, 22, 24 lies in the range from 5 to 50 μm. The material layers 20, 22, 24 are laminated onto the belt core 12 and also onto each other and can be joined together in material-locked manner by the use of glues or thermal action for example.

In principle the material layers 20, 22, 24 can be constructed likewise from polyurethane material, and by adding filler material they can differ from each other with regard to their construction material and hence also with regard to their properties, in particular surface properties such as surface energy. In some embodiments, possible filler materials of this type are, for example, titanium dioxide, calcium carbonate ($CaCO_3$), graphite and metal materials such as aluminum or steel. In some embodiments, these materials can be included in particle form, for example, in the material of the various material layers.

Figure 2:
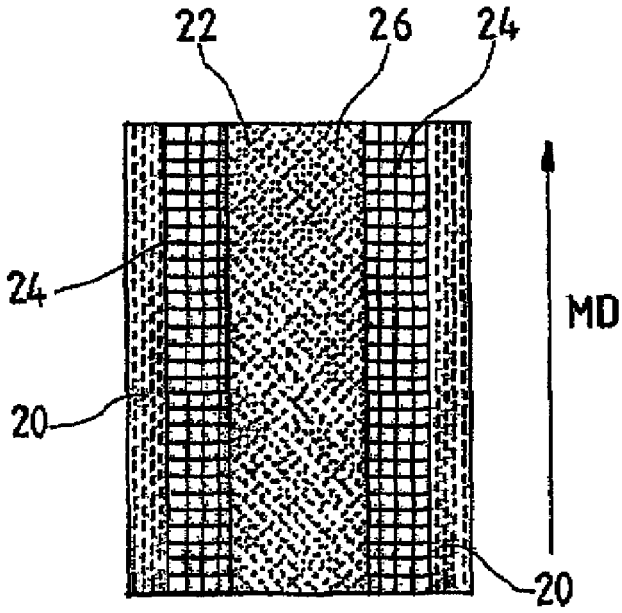
FIG. 2 represents a plan view of the transport belt from FIG. 1 looking in the direction II.

After the material layers 20, 22, 24 are applied to the belt core 12, but before the transport belt 10 is used on a paper production machine for example, the transport belt blank manufactured as described above is subjected to a material-removing process. In this case material is removed from the web material contact side in a grinding process for example, thus producing the web material contact surface 26 with various surface regions provided by the materials layers 20, 22, 24 as is also evident in FIG. 2. The result therefore is a pattern of strips running side by side in the transport belt longitudinal direction, i.e., machine direction (MD), each strip being formed from one of the material layers 20, 22, 24. Consequently, in particular when the various material layers 20, 22, 24 are constructed from different construction materials or from construction materials with mutually different surface properties, there is a variation of surface properties, in particular of the surface energy, over the web material contact surface 26. This means that where the transport belt 10 is guided away from the web material transported thereon, a thin film of water generated between the transport belt 10 and the web material impairs the release far less than is the case when provision is made for a uniform web material contact surface or a web material contact surface constructed from one material. At the same time the material layers 20, 22, 24 providing the various regions of the web material contact surface 26 provide a very smooth, essentially unstructured surface which accordingly reduces the risk of making marks on the finished web material.

The shape or orientation of the various surface regions of the web material contact surface 26 can be varied by corresponding processing of the transport belt blank. Also, in some embodiments, various strip patterns or various surface patterns can be generated in various regions of the transport belt. Dot or island-type variations can also be created. Furthermore, in some embodiments, the surface properties can be influenced further by the type and manner of surface processing. For example, the surface roughness and/or the variation of surface roughness on the web material contact surface can be influenced by the choice of grinding material or by the way in which the grinding operation is performed.

It is noted that the foregoing examples have been provided merely for the purpose of explanation and are in no way to be construed as limiting of the present invention. While the present invention has been described with reference to a preferred embodiment, it is understood that the words which have been used herein are words of description and illustration, rather than words of limitation. Changes may be made, within the purview of the appended claims, as presently stated and as amended, without departing from the scope and spirit of the present invention in its aspects. Although the present invention has been described herein with reference to particular means, materials and embodiments, the present invention is not intended to be limited to the particulars disclosed herein; rather, the present invention extends to all functionally equivalent structures, methods and uses, such as are within the scope of the appended claims.

Further, when an amount, concentration, or other value or parameter, is given as a list of upper preferable values and lower preferable values, this is to be understood as specifically disclosing all ranges formed from any pair of an upper preferred value and a lower preferred value, regardless whether ranges are separately disclosed.

What is claimed is:

1. A transport belt for the production of web material such as paper or paperboard, the transport belt comprising:

a web material contact side having at least two material layers composed of different materials arranged one above the other, in at least two regions of the transport belt on the web material contact side, the at least two material layers are exposed at a web material contact surface, and a belt core supporting the at least two material layers arranged one above the other.

2. The transport belt according to claim 1, wherein at least one of the material layers has a thickness in the range from approximately 5 to approximately 50 μm.

3. The transport belt according to claim 1, wherein at least one of the material layers comprises a polyurethane material.

4. The transport belt according to claim 2, wherein at least one of the material layers comprises a polyurethane material.

5. The transport belt according to claim 1, wherein at least one of the material layers contains a filler material comprising at least one of titanium dioxide, calcium carbonate, graphite, aluminum, or steel.

6. The transport belt according to claim 2, wherein at least one of the material layers contains a filler material comprising at least one of titanium dioxide, calcium carbonate, graphite, aluminum, or steel.

7. The transport belt according to claim 3, wherein the web material contact surface comprises strip-shaped material layers of the various material layers extending side by side in a transport belt longitudinal direction (MD).

8. The transport belt according to claim 1, wherein the web material contact surface comprises strip-shaped material layers of the various material layers extending side by side in a transport belt longitudinal direction (MD).

9. The transport belt according to claim 2, wherein the web material contact surface comprises strip-shaped material layers of the various material layers extending side by side in a transport belt longitudinal direction (MD).

10. A transport belt for the production of web material such as paper or paperboard, the transport belt comprising:

a web material contact side having at least two material layers composed of different materials arranged one above the other, and in at least two regions of the transport belt on the web material contact side, the at least two material layers are exposed at a web material contact surface, wherein the web material contact surface comprises strip-shaped material layers of the various material layers extending side by side in a transport belt longitudinal direction (MD).

11. A method for manufacturing a transport belt for machines for the production of web material such as paper or paperboard, the method comprising:

forming on a belt core a transport belt blank having on a web material contact side, at least two material layers composed of different materials arranged one above the other, and processing a surface of the web material contact side to form at least two regions exposing the different material layers thereby forming the transport belt.

12. The method according to claim 11, wherein the processing a surface of the transport belt blank further comprises the grinding of the transport belt blank on the web material contact side.

13. The method according to claim 11, wherein at least one of the material layers has a thickness in the range from approximately 5 to approximately 50 μm.

14. The method according to claim 13, wherein at least one of the material layers contains a filler material comprising at least one of titanium dioxide, calcium carbonate, graphite, aluminum, or steel.

15. The method according to claim 11, wherein at least one of the material layers comprises a polyurethane material.

16. The method according to claim 11, wherein at least one of the material layers contains a filler material comprising at least one of titanium dioxide, calcium carbonate, graphite, aluminum, or steel.

17. The method according to claim 11, wherein the surface comprises strip-shaped material layers of the various material layers extending side by side in a transport belt longitudinal direction (MD).

* * * * *